US006382080B1

(12) United States Patent
De Angelis et al.

(10) Patent No.: US 6,382,080 B1
(45) Date of Patent: May 7, 2002

(54) APPARATUS FOR SYNCHRONIZATION OF TELESCOPIC RAMS IN HYDRAULIC ELEVATORS

(75) Inventors: Claudio De Angelis, Lucerne (CH); Kjell Johansson, Växjö (SE)

(73) Assignee: Inventio AG, Hergiswil NW (CH)

( * ) Notice: Subject to any disclaimer, the term of this patent is extended or adjusted under 35 U.S.C. 154(b) by 0 days.

(21) Appl. No.: 09/085,512

(22) Filed: May 27, 1998

(30) Foreign Application Priority Data

Jun. 4, 1997 (EP) ..... 97810348

(51) Int. Cl.[7] ..... F01B 7/20
(52) U.S. Cl. ..... 92/52; 92/76; 187/274
(58) Field of Search ..... 91/171, 173, 532; 92/151, 152, 62, 66, 52, 76; 187/272, 274

(56) References Cited

U.S. PATENT DOCUMENTS 870,998 A * 11/1907 Schapler et al. ..... 92/52
1,064,794 A * 6/1913 Wadsworth ..... 187/272
4,624,097 A * 11/1986 Wilcox ..... 57/232
5,566,786 A * 10/1996 De Angelis et al. ..... 187/266

FOREIGN PATENT DOCUMENTS

| | | |
|---|---|---|
| CH | 463 745 | 11/1968 |
| DE | 39 36 754 | 5/1991 |
| EP | 0 314 885 | 5/1989 |
| EP | 0 731 209 | 9/1996 |
| GB | 2 005 773 | 4/1979 |

* cited by examiner

*Primary Examiner*—F. Daniel Lopez
(74) *Attorney, Agent, or Firm*—MacMillan, Sobanski & Todd, LLC

(57) ABSTRACT

An apparatus for synchronizing a telescopic ram in a hydraulic elevator in which two or more pistons and a cylinder are simultaneously extended from and retracted into a foot portion mounted at the bottom of an elevator shaft includes a connecting cable which is fixed on one end to the shaft wall and on the other to one of the pistons and the cylinder and is deflected over a roller used for the synchronization. The connecting cable is a sheathed synthetic fiber cable.

10 Claims, 3 Drawing Sheets

APPARATUS FOR SYNCHRONIZATION OF TELESCOPIC RAMS IN HYDRAULIC ELEVATORS

BACKGROUND OF THE INVENTION

The invention relates to an apparatus for synchronizing the telescopic rams in multi-piston hydraulic elevators.

There is shown in the Swiss patent publication 463 745 a hydraulic or pneumatic synchronous telescopic ram with two or more pistons which are directly loaded by pressure medium and drivable telescopically out of a cylinder, wherein mechanical connecting means engaging between the telescopic parts are present and in each stroke position oblige uniformly distributed part strokes between the successive telescopic parts. Chains or cables, which are not described in more detail and which are to be deflected over rollers, are in particular used as mechanical connecting means.

In the above-described device, chains or cables are provided as mechanical connecting means. In practice, however, only chains have proved themselves up to the present day, because in the case of the properties of cables, especially steel cables, the necessary small bending radii, which can be realized by chains, would lead to premature wear and to strand or cable breakage. In order to be able to bring about the required conditions for a fault-free and safe operation for steel cables, large bending radii of, at the minimum, 30 times the cable diameter would have to be realized, which would lead to a huge increase in the shaft dimensions.

Chains and toothed wheels as deflections have, on the other hand, the disadvantage that they produce vibrations that are transmitted to the pistons and to the car. The general range of use of such stroke pistons can go fully into the region of 5 to 10 tons useful load. That creates the problem that, in the case of increasing useful load, for synchronization of the piston stages forces are reached which can be translated by a corresponding dimensioning of the chains. Nevertheless, the necessary space for the chain deflecting wheels is not enlarged. This means that due to the stronger chains, coarser links are required, which have fewer engagement points for a like tooth number of the chain wheels. Practice shows that the fewer engagement points by the chain in the chain deflecting wheel are effected, the greater are the frequencies that are generated by the combination of chain and chain deflecting wheel. These frequencies are transmitted to the car by way of the pistons and can be unpleasantly felt by the passengers in the form of strong vibrations. The frequencies generated by the chain and chain deflecting wheels can, passed on to pistons and car, excite other car components and parts in terms of frequency, which then become apparent in the form of undesired additional noises. Overall, the travel comfort is negatively influenced to a significant extent by the use of chains and chain deflecting wheels. Steel cables, but especially also chains, must be fundamentally greased before installation in view of their characteristics with respect to corrosion and wear. Moreover, assembling, particularly in the case of chains, is made difficult by their substantial weight. Further assembly aids and an additional person are necessary for assembling. This extra cost reduces productivity during installation.

SUMMARY OF THE INVENTION

The present invention has the object of providing a device for the synchronization of telescopic rams in hydraulic elevators of the kind described above, which device does not have the aforesaid disadvantages.

The advantages achieved by the apparatus according to the present invention are that in the case of sheathed synthetic fiber cables substantially smaller bending radii can be realized for like force transmission by comparison with steel cables. The small deflecting radii with chains can be adopted by the synthetic fiber cables or even reduced without needing to have the disadvantageous mechanically coupling points of contact of the chain in the chain deflecting wheel.

Advantageous developments and improvements of the device, for the synchronization of telescopic rams in hydraulic elevators, are possible. Instead of having to use toothed wheels, as required for chains, or large diameter deflecting rollers, as required for steel cables, simple deflecting rollers without roller bearings, for example deflecting rollers of polyamide, are sufficient in the case of use of non-abrasive synthetic fiber cables. Moreover, due to the character of cables of synthetic fibers, the deflecting rollers can be dimensioned to be significantly smaller in their diameters, which means an additional saving of space in the shaft compared to steel cables. Because of the low weight of the lubricant-free synthetic fiber cables, a substantially simpler and thus quicker installation is possible. A sheathing imparts to the synthetic fiber cable a very high resistance to mechanical and chemical damage and to ultraviolet rays. Maintenance, as with steel cables, for example in order to grease the cables, is no longer necessary. Moreover, in view of length extension now able to be disregarded, the synthetic fiber cable no longer has to be readjusted. For increasing the visual effect of an elevator, for example of a panoramic elevator, the sheathing of the synthetic fiber cable can be provided with any desired color or a logo. Finally, the synthetic fiber cable can be equipped in simple mode and manner with a device for precautionary recognition of disruption due to possible wear.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
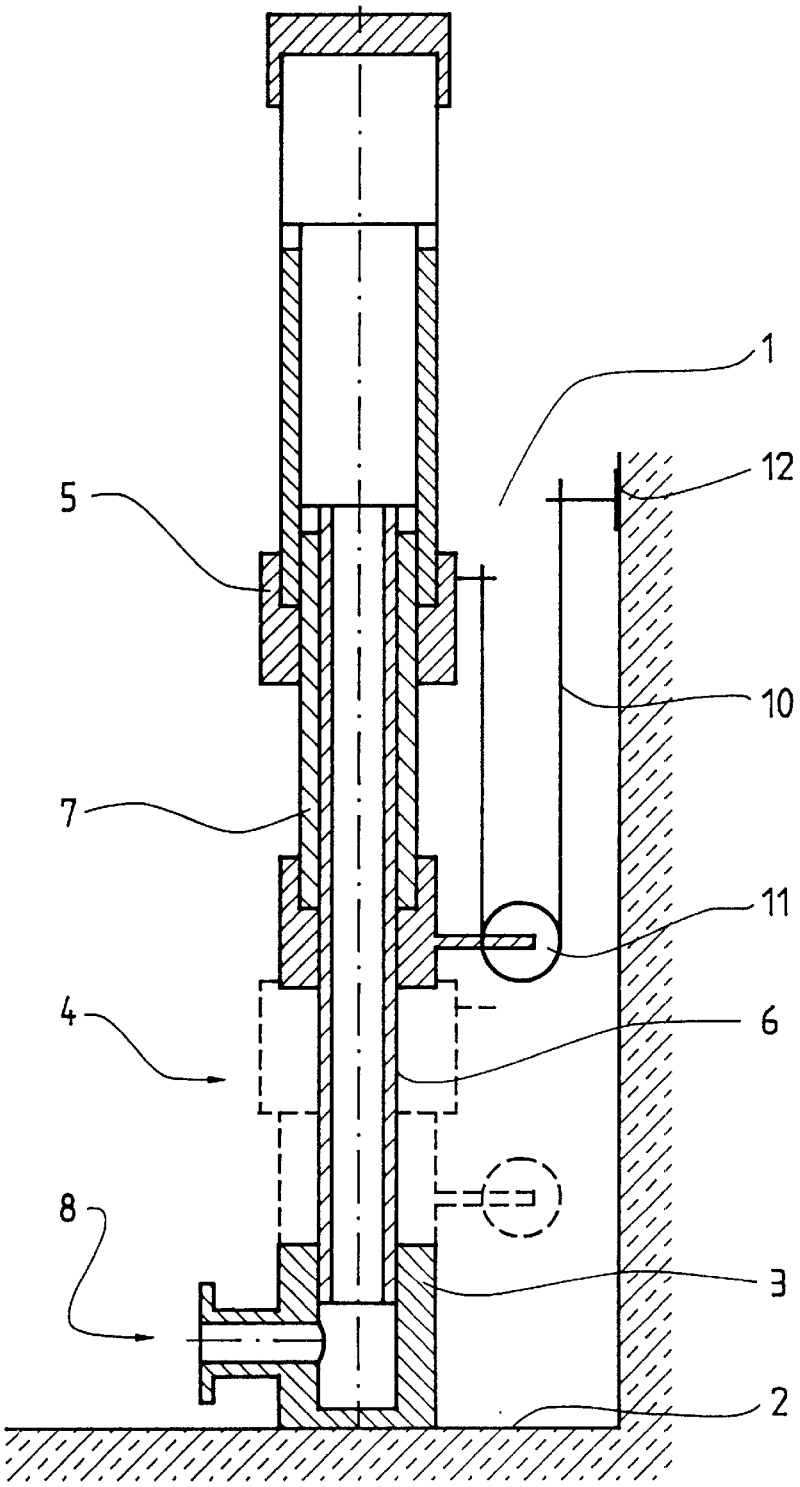
FIG. 1 is a schematic view of a hydraulic elevator telescopic ram having two pistons with a synchronization apparatus according to the present invention.

In the FIG. 1, a shaft 1 of a hydraulic elevator installation is shown as having a shaft foundation 2 at a bottom thereof A foot portion 3 for the mounting of a telescopic ram 4 of a hydraulic elevator installation is fastened to the shaft foundation 2. The telescopic ram 4 includes of a cylinder 5 having a first piston 6 and a second piston 7 extending therefrom. The arrangement of the telescopic ram 4 in the shaft 1 is in accordance with the respective embodiment of lift, for example as a "rucksack" arrangement with one telescopic ram 4, as shown, or as a tandem arrangement with two or more of the telescopic rams 4. The first piston 6 and the second piston 7 are drivable from a starting position (illustrated by dashed lines) out of the cylinder 5 when a hydraulic pressure medium, for example oil, is pumped into the foot portion 3 from a pump, which is not illustrated in detail here, by way of an inlet opening 8. Similarly, upon releasing the pressure medium, the two pistons 6 and 7 can return to the starting position. Thus, the cylinder 5 and the pistons 6 and 7 are movable relative to the foot portion 3.

In order to be able to ensure a jerk-free running during extending or retracting of the two pistons 6 and 7, the pistons are moved synchronously. For this purpose, a mechanical connecting means, 10, in the form of a synthetic fiber cable, is fastened at one end to the second piston 7, which connecting means is deflected around a roller 11 arranged and rotatably mounted at the first piston 6 and is fixed at an opposite end to a fastening device 12 mounted at a suitable height on the shaft wall. In this manner, the two pistons 6 and 7 can be simultaneously driven in and driven out at the same speed, wherein the two pistons are always moving together so that no jerky transitions in speed arise. A jerky transition would be the case if initially only the first piston 6 alone were driven out or driven in to the maximum and if only then the second piston 7 were moved.

A substantial reduction in the vibrations produced during operation is possible through the use of the synthetic fiber cable 10, instead of chains, as the mechanical connecting means. Equally, the synthetic fiber cable 10 prevents the transmission of frequencies generated in the telescopic ram 4 or the pistons 6 and 7, so that noises in the shaft 1 cannot propagate on by way of the synthetic fiber cable.

Figure 2:
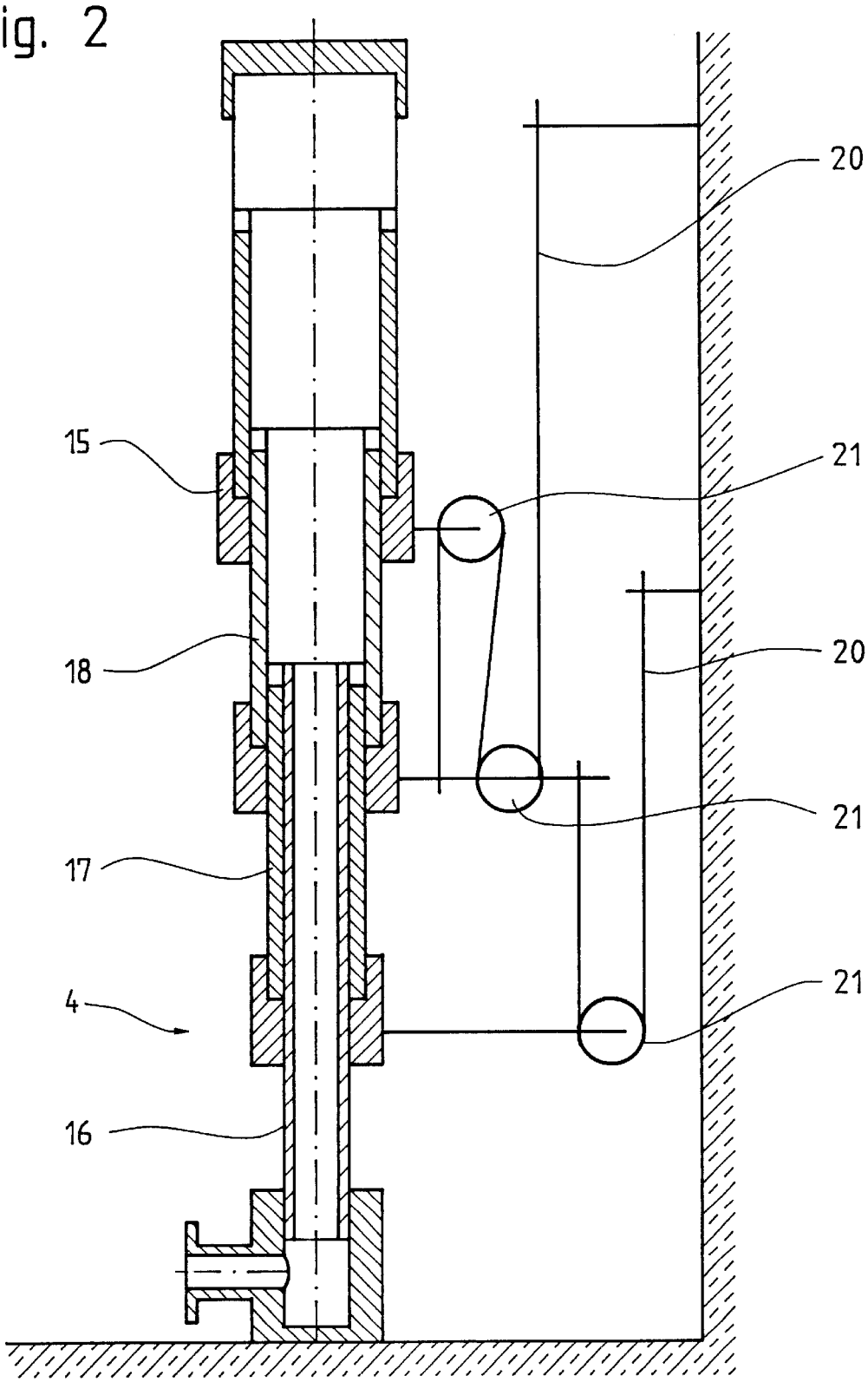
FIG. 2 is a schematic view of a hydraulic elevator telescopic ram having three pistons with a synchronization apparatus according to the present invention.

As shown in the FIG. 2, the synchronization at a telescopic ram 4' also is possible with more than two pistons such as with a cylinder 15 having a first piston 16, a second piston 17 and a third piston 18 extending therefrom. In this embodiment, the first piston 16 and the second piston 17 are connected together by a first synthetic fiber cable **20*a* deflected by a roller 21 as described in connection with the first embodiment shown in the FIG. 1. The second piston 17 and the third piston 18 are similarly connected together by a second synthetic fiber cable 20*b*, which, however, is deflected at the cylinder 15 and at the third piston by way of respective ones of a pair of the rollers 21. In that case, the synthetic fiber cable 20*b* is fixed at one end to the third piston 18 and at the other end to the shaft wall. Due to the synthetic fiber cables 10, 20*a* and 20*b* used rotatably journalled rollers 11 and 21**, for example formed of polyamide material, can be used so that bearings are not required.

Figure 3:
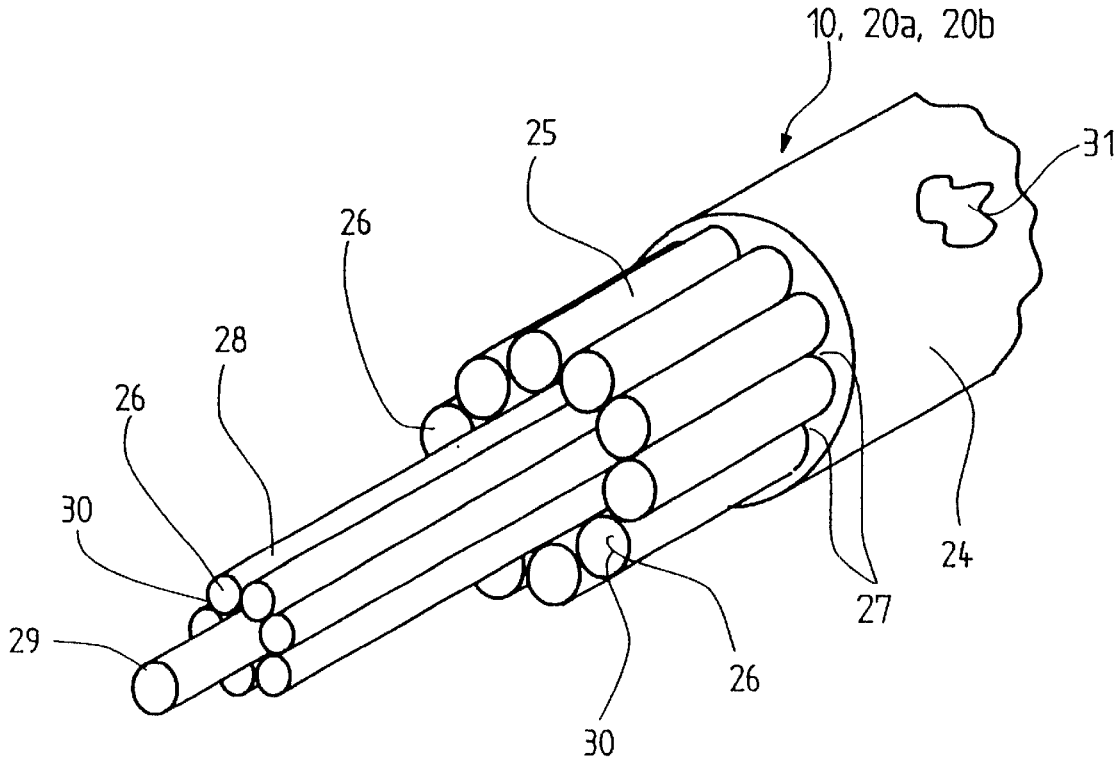
FIG. 3 is a perspective fragmentary view of a synthetic fiber cable used with the synchronization apparatus according to the present invention.

There is shown in the FIG. 3 a perspective illustration of the synthetic fiber cable 10, **20*a*, 20*b* as the connecting means. An outer sheathing 24 surrounds an outermost strand layer 25. By virtue of the sheathing 24 of synthetic material, preferably polyurethane, the friction value of the synthetic fiber cable 10, 20*a*, 20*b* on the rollers 11, 21 is variably settable. Further, the sheathing 24 imparts to the synthetic fiber cable 10, 20*a*, 20*b* a very high resistance to mechanical and chemical damage (from, for example, hydraulic oil) and to ultraviolet rays. Maintenance, as required for steel cables, for example in order to grease the cables, is not necessary. The friction value of the sheathing 24 on the rollers 11, 21 can be defined by a different character of the surface of the sheathing (for example, smooth or structured). According to the respective loading demands on the synthetic fiber cable 10, 20*a*, 20*b*, one or more strand layers 25 and 28 of a plurality of strands 26 are provided. Finally, all of the strands 26 are laid around a core 29 in layers counterclockwise or clockwise or alternatively counterclockwise and clockwise. The sheathing 24 can enclose and encapsulate the strands 26 and the core 29 filling all intermediate spaces 27** to form a solid cross-section flexible cable.

The supporting strands 26 can be twisted from individual aramide fibers 30. For the protection of the aramide fibers 30, each individual strand 26 is treated with an impregnating means, for example polyurethane solution. The reversed bending capability of the synthetic fiber cable 10, **20*a*, 20*b* is dependent on the proportion of polyurethane in each strand 26. The higher the proportion of polyurethane, the higher is the reverse bending-strength. The polyurethane component for impregnation of the strands 26** can lie, according to the respectively desired reversed bending strength, between, for example, ten and sixty percent.

The aramide fibers 30, which consist of high-level oriented molecular chains, have a very high tensile strength. By comparison with a steel cable, the synthetic fiber cable 10, **20*a*, 20*b* can for the same cross-section have a substantially higher load-bearing capability, which is dependent on the filling degree of the cross-section, but has only one fifth to one sixth of the specific weight. For this reason, for the same load-bearing capability the size of the bending radii of the synthetic fiber cable 10, 20*a*, 20*b* can accordingly be strongly reduced by comparison with a conventional steel cable. Due to the low weight and due to the lubricant-free state, the synthetic fiber cables 10, 20*a*, 20*b* can be installed substantially more easily and thus more quickly. Moreover, because of only very small length extension, the synthetic fiber cable 10, 20*a*, 20*b*** no longer has to be readjusted during operation, as is usual with steel cables.

Further advantages through the use of the synthetic fiber cable 10, **20*a*, 20*b* result from the fact that the diameter of the rollers 11, 21 can be selected to be much smaller than for steel cables, which produces a considerable saving in space. The roller diameter for synthetic fiber cables is in the region of ten to twenty times the cable diameter. In the case of a diameter of the synthetic fiber cable 10, 20*a*, 20*b* of about six to ten millimeters, a diameter for the rollers 11, 21 in a range of about one hundred forty millimeters results therefrom. By comparison therewith, for steel cables there is required a roller diameter thirty times the cable diameter. In the case of a cable diameter of ten to fifteen millimeters, a roller diameter of three hundred to four hundred fifty millimeters would be needed. For an increase in the visual effect of an elevator, for example of a panoramic elevator, all or a portion an outer surface of the sheathing 24 of the synthetic fiber cable 10, 20*a*, 20*b* can be provided with any desired color and/or a logo 31**.

A device in accordance with the equipment described in the European patent document 0 731 209, for the recognition of readiness for replacement of synthetic fiber cables, can be used in conjunction with the apparatus according to the present invention for the recognition of premature wear and thus for preventative maintenance.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for the synchronization of a telescopic ram mounted in a hydraulic elevator shaft of a building, the telescopic ram having relatively movable portions including at least two concentric pistons in a cylinder, the pistons and the cylinder being movably slidable-relative to one another, the apparatus comprising:

a connecting means adapted to be fixed at one end to the building and at an opposite end to one of the movable portions of the ram and deflected over at least one deflecting roller mounted to another of the movable portions of the ram, said connecting means being formed as a sheathed synthetic fiber cable; and said at least one deflecting roller having a diameter in a range of 10 to 17 times a diameter of said cable, said cable extending partially about said one deflecting roller, whereby when said one deflecting roller is mounted on the another movable portion of the telescopic ram, said one end of said cable is attached to the building and said opposite end of said cable is attached to the one movable portion of the ram, said connecting means causes the one movable portion and the another movable portion to move synchronously as the ram is extended and retracted.

2. The apparatus according to claim 1 wherein said one deflecting roller has a diameter of approximately 140 millimeters.

3. The apparatus according to claim 1 wherein said one deflecting roller is formed of a synthetic material being a polyamide.

4. The apparatus according to claim 3 wherein said deflecting roller is rotatably journalled to the ram.

5. The apparatus according to claim 1 wherein said synthetic fiber cable is formed with an outer sheathing made of a synthetic material being polyurethane.

6. The apparatus according to claim 5 wherein said outer sheathing encloses and encapsulates an outermost strand layer having a plurality of strands by filling all intermediate spaces between said strands of said outermost strand layer.

7. The apparatus according to claim 6 wherein said strands are formed by a plurality of twisted aramide fibers.

8. The apparatus according to claim 1 wherein sheathing of said synthetic fiber cable has an outer surface with at least a portion thereof bearing at least one of a color and a logo.

9. A telescopic ram for use in a hydraulic elevator shaft in a building comprising:

a cylinder for mounting in the hydraulic elevator shaft;

at least three pistons cooperating with said cylinder for extension from and retraction into said cylinder;

at least three rollers; and at least two cables wherein a first one of said rollers is rotatably mounted on a second one of said pistons, a first one of said cables is deflected over said first roller and has opposite ends attached to the building and a third one of said pistons, a second one of said rollers is rotatably mounted on said third piston, a third one of said rollers is rotatably mounted on said cylinder, and a second one of said cables is deflected over said second and third rollers and has opposite ends attached to a wall of the shaft and said third piston, said cables being formed as a sheathed synthetic fiber cable.

10. The apparatus according to claim 9 wherein each of said rollers has a diameter in a range of 10 to 20 times a diameter of each of said sheathed synthetic fiber cables.

* * * * *